US010690131B2

(12) United States Patent
Rashid et al.

(10) Patent No.: US 10,690,131 B2
(45) Date of Patent: Jun. 23, 2020

(54) METHOD AND SYSTEM FOR MINIMIZING VIBRATION IN A MULTI-PUMP ARRANGEMENT

(71) Applicant: SCHLUMBERGER TECHNOLOGY CORPORATION, Sugar Land, TX (US)

(72) Inventors: Kashif Rashid, Wayland, MA (US); Sandeep Verma, Acton, MA (US); Kim Hodgson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 198 days.

(21) Appl. No.: 15/546,227

(22) PCT Filed: Jan. 22, 2016

(86) PCT No.: PCT/US2016/014475

§ 371 (c)(1),
(2) Date: Jul. 25, 2017

(87) PCT Pub. No.: WO2016/122978

PCT Pub. Date: Aug. 4, 2016

(65) Prior Publication Data

US 2018/0003171 A1 Jan. 4, 2018

Related U.S. Application Data

(60) Provisional application No. 62/107,893, filed on Jan. 26, 2015.

(51) Int. Cl.
*E21B 43/26* (2006.01)
*F04B 49/06* (2006.01)
(Continued)

(52) U.S. Cl.
CPC ..... *F04B 49/065* (2013.01); *E21B 33/13* (2013.01); *E21B 43/26* (2013.01); *F04B 11/005* (2013.01);
(Continued)

(58) Field of Classification Search
CPC combination set(s) only.
See application file for complete search history.

(56) References Cited

U.S. PATENT DOCUMENTS 4,705,459 A 11/1987 Buisine et al.
5,246,355 A 9/1993 Matzner et al.
(Continued)

OTHER PUBLICATIONS

International Search Report and Written Opinion issued in International Patent Appl. No. PCT/US2016/014475 dated Jan. 22, 2016; 17 pages.

*Primary Examiner* — Cathleen R Hutchins
*Assistant Examiner* — Ronald R Runyan
(74) *Attorney, Agent, or Firm* — Cathy Hewitt

(57) ABSTRACT

A technique for reducing harmonic vibration in a multiplex multi-pump system. The technique includes establishing a lower bound of system specific vibration-related information such as via pressure variation or other vibration indicator. Establishing the lower bound may be achieved through simulation with the system or through an initial sampling period of pump operation. During this time, random perturbations through a subset of the pumps may be utilized to disrupt timing or phase of the subset. Thus, system vibration may randomly increase or decrease upon each perturbation. Regardless, with a sufficient number of sampled perturbations, the lower bound may be established. Therefore, actual controlled system operations may proceed, again employing random perturbations until operation of the system close to the known lower bound is substantially attained.

19 Claims, 5 Drawing Sheets

(51) Int. Cl.

| | |
|---|---|
| ***F04B 23/04*** | (2006.01) |
| ***F04B 11/00*** | (2006.01) |
| ***F04B 53/00*** | (2006.01) |
| ***F04B 15/02*** | (2006.01) |
| ***E21B 33/13*** | (2006.01) |
| ***F04B 49/20*** | (2006.01) |
| ***F04B 51/00*** | (2006.01) |

(52) U.S. Cl.
CPC ..... *F04B 15/02* (2013.01); *F04B 23/04* (2013.01); *F04B 49/20* (2013.01); *F04B 51/00* (2013.01); *F04B 53/001* (2013.01)

(56) References Cited

U.S. PATENT DOCUMENTS

| | | | | |
|---|---|---|---|---|
| 5,259,731 | A | 11/1993 | Dhindsa et al. | |
| 5,522,707 | A | 6/1996 | Potter | |
| 5,755,561 | A | 5/1998 | Couillard et al. | |
| 5,971,714 | A | 10/1999 | Schaffer et al. | |
| 7,542,875 | B2 | 6/2009 | Rogers | |
| 7,581,449 | B2 | 9/2009 | Miller | |
| 7,811,064 | B2 | 10/2010 | Allen | |
| 2004/0256097 | A1 | 12/2004 | Byrd et al. | |
| 2007/0017672 | A1 | 1/2007 | Kayadarma | |
| 2010/0200239 | A1* | 8/2010 | Aften ..... | C09K 8/68 166/308.2 |
| 2011/0189028 | A1 | 8/2011 | Shampine et al. | |
| 2011/0272158 | A1* | 11/2011 | Neal ..... | B67D 7/36 166/305.1 |
| 2012/0255734 | A1 | 10/2012 | Coli et al. | |

* cited by examiner

METHOD AND SYSTEM FOR MINIMIZING VIBRATION IN A MULTI-PUMP ARRANGEMENT

CROSS REFERENCE TO RELATED APPLICATION(S)

This Patent Document claims priority under 35 U.S.C. § 119(e) to U.S. Provisional Application Ser. No. 62/107,893, entitled Method for Reducing Pressure Fluctuations and Associated Vibrations in Positive Displacement Pumps, filed on Jan. 26, 2015, which is incorporated herein by reference in its entirety.

BACKGROUND

Exploring, drilling and completing hydrocarbon and other wells are generally complicated, time consuming and ultimately very expensive endeavors. As a result, oilfield efforts are often largely focused on techniques for maximizing recovery from each and every well. Whether the focus is on drilling, unique architecture, or step by step interventions the techniques have become quite developed over the years. In large scale oilfield operations, the development of the well and follow-on interventions may be carried out through the use of several positive displacement pumps. For example, in applications of cementing, coiled tubing, water jet cutting, or hydraulic fracturing of underground rock, 10 to 20 or more pumps may be simultaneously utilized at the oilfield for a given application.

Each positive displacement pump may be a fairly massive piece of equipment with associated engine, transmission, crankshaft and other parts, operating at between about 200 Hp and about 4,000 Hp. A large plunger is driven by the crankshaft toward and away from a chamber in the pump to dramatically effect a high or low pressure. This makes it a good choice for high pressure applications. A positive displacement pump is generally used in applications where fluid pressure exceeding a few thousand pounds per square inch gauge (psig) is required. Hydraulic fracturing of underground rock, for example, often takes place at pressures ranging from a few hundred to over 20,000 psig to direct an abrasive containing slurry through an underground well to release oil and gas from rock pores for extraction. A system with 10-20 pumps at the oilfield may provide a sufficient flowrate of the slurry for the application, for example, between about 60-100 barrels per minute (BPM).

In the above described multi-pump system, each one of the pumps are fluidly connected to a manifold which delivers the slurry fluid to the wellhead. Thus, the pumps are hydraulically linked to one another. As a result, while each pump may be subject to its own individual wear and performance factors, the efficiency and health of the overall system is subject to factors such as fluctuating pressure and flow interaction among all of the pumps.

One circumstance where the health of the overall system may be of concern due to multi-pump interaction is in the case of excessive, prolonged, or cumulative vibrations reverberating through the lines. For example, with a variety of pumps utilized, it is unlikely that all of the pumps will continuously pump in sync with one another. Nevertheless, from time to time, multiple pumps of the system may randomly come into phase or sync with one another as they pump. When this occurs, the inherent vibrations from pumping are cumulatively felt by the system, often in dramatic fashion.

More specifically, for any given pump, the plunger reciprocates in a sinusoidal fashion as described above. That is, while a mean flow may be obtained from each pump, the reality is that at any given moment, the pump flow rate follows a sinusoidal curve in terms of position over time. Thus, the above described vibration is seen at each pump during operation. Once more, when the vibration from several pumps come into harmony with one another, the degree of vibration may damage the system. By way of specific example, this damage may include harm to valves, the manifold or the rupturing of an exposed line often at an elbow or at some other natural weakpoint.

Rupturing of a line in particular may be catastrophic to operations. For example, recalling that the extremely high flow rate and pressures involved, this may present itself as an explosion-like event at the oilfield. Thus, operator safety may be of greatest concern. Once more, in addition to repair and/or replacement cost of the ruptured line, there is a high probability that other adjacent high dollar equipment would also be subject to damage and also require repair and/or replacement. Further, regardless the extent of the damage, there will be a need to shut down all operations at the wellsite for damage assessment and remediation of the system before operations may resume. Ultimately, even in fortunate circumstances where operator injury is avoided, there will still be potentially hundreds of thousands of dollars of capital and time lost due the vibration-induced system damage.

In an effort to avoid vibration-induced system damage as a result of multiple pumps coming into sync with one another, efforts may be undertaken to ensure that all pumps are kept out of sync with each other. Specifically, in theory, each pump may be extensively monitored and controlled to help avoid synchronization or constructive interference at various locations along the manifold. For example, sensors at each pump may be employed along with real-time controls for continuously monitoring and adjusting the phase of each pump to ensure that multiple pumps are never allowed to come into sync with one another, as manifested by measuring the peak-to-peak pressure pulsation or vibration amplitude at various locations along the manifold.

Unfortunately, simultaneously monitoring and controlling 10 to 20 pumps at the oilfield in this manner is not generally a practical endeavor. That is, as noted above, each pump is a massive piece of equipment reciprocating at a very high rate of speed. Thus, the ability to not only manually precisely adjust the timing of each pump in real-time, but to also do so on the fly based on the phase of each and every other pump quickly becomes a largely impractical endeavor. Therefore, as a practical matter, operators are generally left manually monitoring piping and pumps for unduly high vibrations and taking control action, such as manually adjusting pump rates. However, given the manual nature of this particular undertaking, the avoidance of sudden catastrophic vibration damage is hardly assured.

SUMMARY

A method of minimizing vibration in an operating multi-pump system. The method includes establishing a predetermined acceptable pressure variation for the system corresponding to the minimizing of the vibration. Each pump of the system may operate at substantially the same predetermined rate. However, in order to maintain the acceptable pressure variation and keep system vibration to an acceptable level, a phase of one pump of the system may be altered by temporary manipulation of its operating rate. Thus, a new pressure variation may be introduced to the system that is closer to the established acceptable pressure variation for the system.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments are described with reference to certain embodiments of stimulation operations at an oilfield. Specifically, a host of triplex pumps, a manifold and other equipment are referenced for performing a stimulation application. However, other types of operations may benefit from the embodiments of minimizing pump-related vibration in such a multi-pump system. For example, such techniques may be employed for supporting fracturing, cementing or other related downhole operations supported by other types of multiplex high pressure pumps, such as quintuplex pumps. Indeed, so long as the pump rate of a single pump, or some number of pumps fewer than the total of the system, may be adjusted based on random walk data, appreciable benefit may be realized in terms of minimizing pump-related vibration for the system as a whole.

Figure 1:
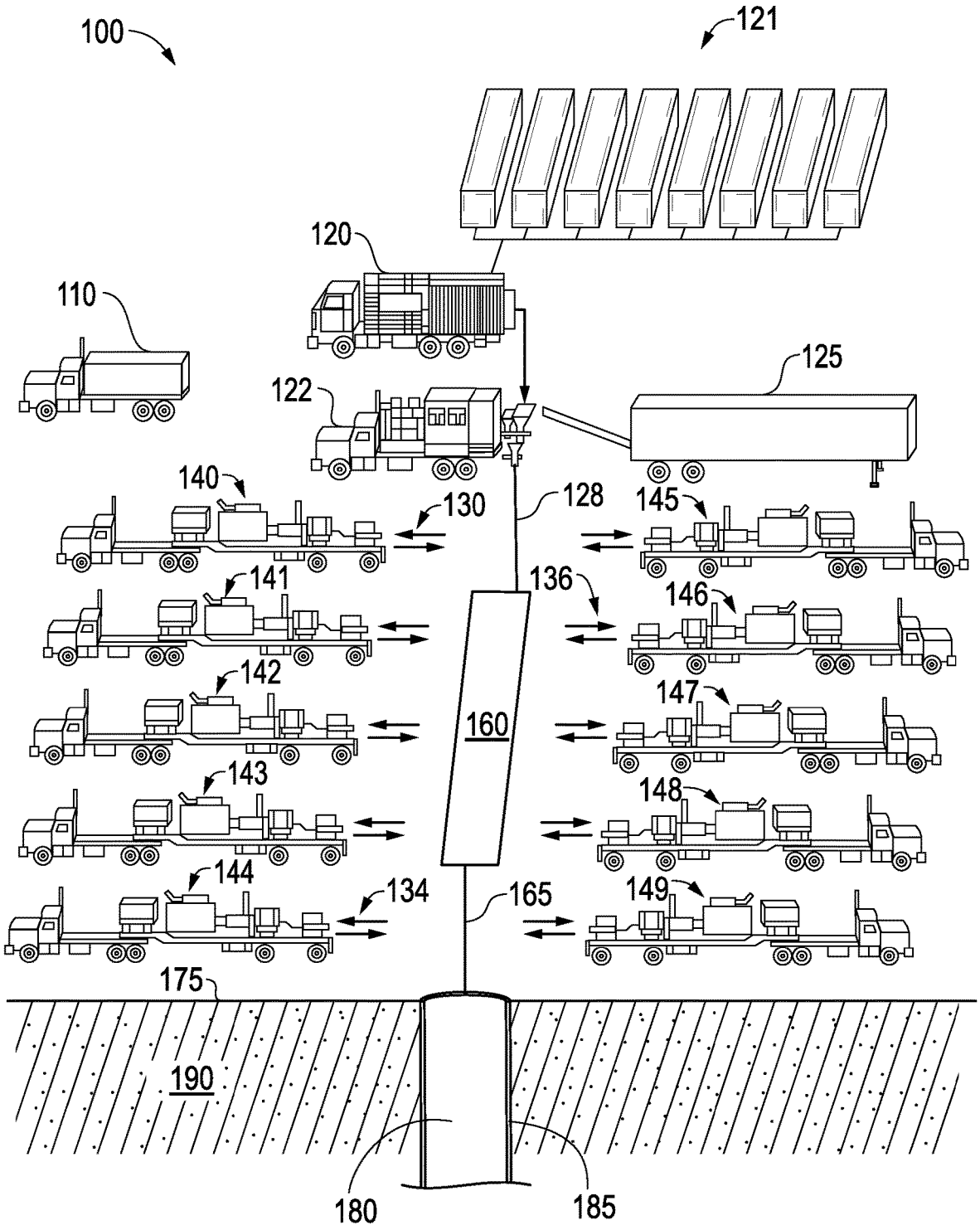
FIG. 1 is a schematic overview depiction of a multi-pump system at an oilfield employing an embodiment of a vibration minimization technique.

Referring now to FIG. 1, a schematic overview depiction of a multi-pump system 100 at an oilfield 175 is shown. Specifically, the system 100 employs an embodiment of a vibration minimization technique that is particularly beneficial in a circumstance where a plurality of different pumps 140-149 are hydraulically hooked up to a manifold 160. That is, as alluded to above, each pump 140-149 may be a large scale piece of equipment, operating at between about 200 Hp and about 4,000 Hp with large crankshaft driven plungers reciprocating therein. Thus, ultimately each pump may contribute to an overall pressure as measured in pounds per square inch gauge (psig). In this way, the combined efforts may lead to the manifold 160 supplying a slurry to a well 180 at pressures of a few hundred to several thousand psig or more for a downhole application. Therefore, as detailed herein, techniques are described to help minimize any potential constructive interference among multiple pumps 140-149 at a plurality of locations in the manifold 160 that might rise to a level that could harm system equipment. In addition, techniques are also described that help avoid establishment of acoustic or mechanical resonance at any point in the system 100.

FIG. 1 depicts a typical layout for a stimulation or hydraulic fracturing system 100 at an oilfield 175. Apart from the unique vibration minimization techniques referenced above and detailed further below, the system 100 includes common equipment for such operations. As depicted, the pumps 140-149 are each part of a mobile pump truck unit. Thus, once properly disconnected, a pump 140-149 may be driven away and perhaps replaced by another such mobile pump if necessary. Further, a mixer 122 is provided that supplies a low pressure slurry to the manifold 160 for eventual use in a stimulation application in the well 180. In the embodiment shown, the well 180 is outfitted with casing 185 and may have been previously perforated and now ripe for stimulation. Regardless, the slurry is initially provided to the manifold 160 over a line 128 at comparatively low pressure, generally below about 100 psig. However, for sake of the application, the slurry will be pressurized by the pumps 140-149 before being returned to the manifold 160 at high pressure, for the application. Specifically, pressures of between about 20 psig and about 15,000 psig or more may be seen at the line 165 running to the well 180 for the stimulation application.

The mixer 122 is used to combine separate slurry components. Specifically, water from tanks 121 is combined with proppant from a proppant truck 125. The proppant may be sand of particular size and other specified characteristics for the application. Additionally, other material additives may be combined with the slurry such as gel materials from a gel tank 120. From an operator's perspective, this mixing, as well as operation of the pumps 140-149, manifold 160 and other system equipment may be regulated from a control unit 110 having suitable processing and electronic control over such equipment. Indeed, as detailed further below, the control unit 110 may be outfitted with a capacity for remotely and temporarily altering the speed of one or more pumps 140-149 to ultimately promote a destructive interference and minimize peak-to-peak pressure and associated vibrations in a plurality of locations in the operating system 100.

Continuing with reference to FIG. 1, for ease of illustration, the physical hydraulic linkages between the pumps 140-149 and the manifold 160 are depicted as sets of arrows 130-139 running toward and away from each pump. Specifically, an arrow running toward a given pump 140-149 represents a low pressure hookup for slurry in need of pressurization. Alternatively, an arrow running away from this pump 140-149 represents a high pressure hookup for slurry ready to be delivered to the well 180 from the manifold 160. The physical hydraulic linkages 130-139 are depicted in a simplified manner for sake of illustration at FIG. 1. However, the reality is that these linkages 130-139 may constitute a variety of hydraulic lines carrying pressurized fluid at upwards of 10,000 psig or more through a web of elbow joints, valves and other hydraulic features potentially prone to failure depending on vibration levels. The control scheme described is utilized in a manner that substantially maintains the overall flowrate and pressure in the system 100.

In order to minimize vibration in the system without substantially reducing flow rate or pressure and thereby compromising the application, embodiments herein utilize a random walk technique to promote destructive interference in phase cycling of one or more of the pumps 140-149. More specifically, the control unit 110 may store pressure variation or other information indicative of vibration that is particular to the system 100 at hand. This information, which may be referred to as sampling information, may be pre-stored and based on a simulation of the running system or acquired at the outset of actual operations with the system 100. Regardless of origin, the information relied upon is particular to the system 100 at the oilfield 175 given the overall scale, dynamic behavior and uniqueness of all such large scale operations.

As detailed below, with such pressure variation sampling mode information available, which is particular to the system 100, operations may proceed. Once in operation, the application may be adjusted by the control unit 110 at random through a single temporary adjustment to the rpm of one of the pumps 140-149. Indeed, this "control mode" adjustment may be done repeatedly until a substantially maximal destructive interference is attained due to the interrupted phase timing of the adjusted pump 140-149 (and as confirmed by the noted sampling mode information for the system 100). Once more, while this type of random interruption may be exerted on a subset that includes more than one of the pumps 140-149, an effective and substantially similar vibration reduction may be attained through adjustment to a single pump 140 as detailed further below.

Figure 2A:
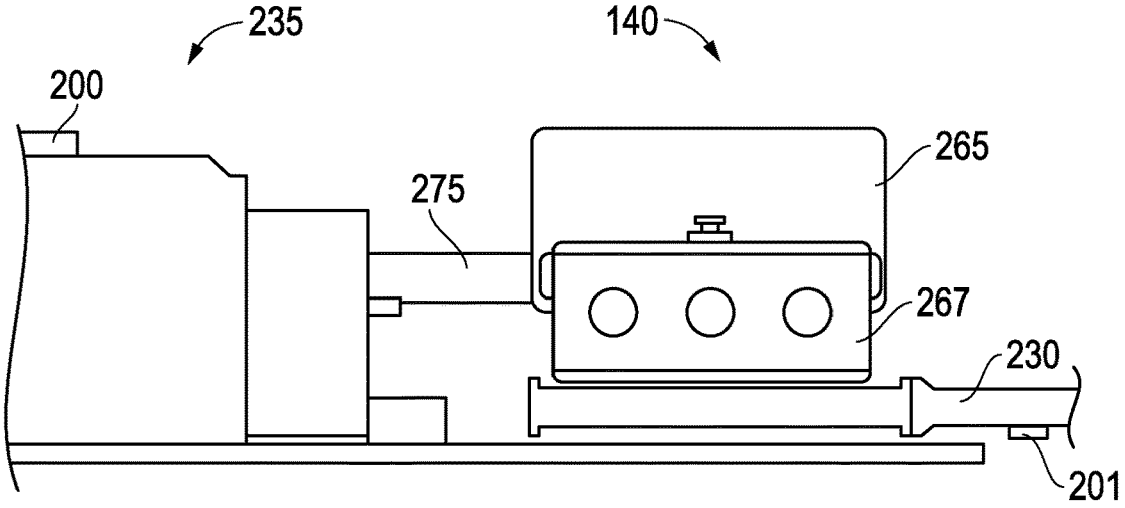
FIG. 2A is an enlarged side view of a pump of FIG. 1 for pressurizing and circulating a stimulation slurry at a given rate to a manifold at the oilfield.
Figure 2B:
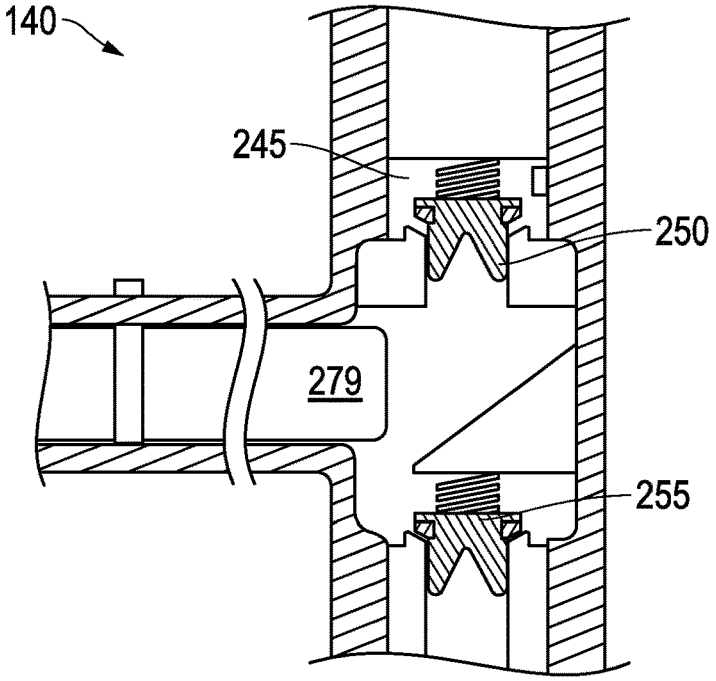
FIG. 2B is an enlarged cross-sectional view of a portion of the pump of FIG. 2A revealing the reciprocating piston therein for effecting the given rate.

Referring now to FIGS. 2A and 2B, with added reference to FIG. 1, the operation of one of the pumps 140 of the system 100 is described in terms of the inherent vibrations that may be generated and monitored. Specifically, FIG. 2A depicts an enlarged side view of a pump 140 of FIG. 1. As detailed above, the pump 140 is configured for circulating a stimulation slurry from the manifold 160 and back thereto at an increased pressure. FIG. 2B is an enlarged cross-sectional view of a portion of the pump 140 of FIG. 2A revealing a reciprocating plunger 279 and a valve system 245, with valves 250, 255, therein which may tend to generate the noted vibrations.

The pump 140 of FIGS. 2A and 2B is a positive displacement pump fully capable of generating sufficient pressure for a stimulation or fracturing application. In the embodiment shown, the pump 140 is of a triplex configuration. This means that three plungers 279 reciprocate in phases separated by about 120° from one another to take a stimulation slurry from the manifold 160 at a pressure of less than about 100 psig up to 7,500 psig discharged to the manifold 160 for the application. This is achieved by routing the low pressure slurry to a fluid housing 267 of the pump 140 for pressurization. Specifically, an engine 235 of the pump 140 may power a driveline mechanism 275 to rotate a crankshaft 265 and effect the pressure increase in the adjacent fluid housing 267.

As indicated above, inherent vibrations are induced by the triplex pump 140 during operation as the plungers 279 move at an increasing speed in one direction, stop, and then move back in the opposite direction, also at an increasing speed. This oscillating behavior translates to a fluctuation in hydraulic behavior by potentially hundreds of psig per reciprocation. There may be 10-25 reciprocating pumps in simultaneous operation that naturally give rise to high pressure pulsations. These pressure fluctuations induce acoustic and mechanical resonance that leads to excessive vibration, which in turn causes considerable wear and damage to the pump and piping network, potentially with catastrophic consequences.

In a typical reciprocating pump design, rods connected to a crank drive multiple plungers which are offset in phase. Plungers accelerate between maximum positive and negative velocities in an oscillating curve. Subsequently, pressure and flow follow oscillating characteristics. The pressure and flow rate variation is mitigated due to the combination of flow from multiple (three or five) plungers designed to be out of phase within a multiplex pump. Nonetheless, the resultant flow contains pulses that may cause issues in downstream piping. As these pumps frequently operate at pressures in excess of 10,000 psig with pressure fluctuations in hundreds of psig, fluid compressibility becomes relevant and liquids must be modeled as compressible fluids.

Transient fluid flow in piping networks leads to another source of acoustic resonance. The pressure pulses from the pumps induce wave-guided acoustic modes in the pipes that travel at the wave speed along the pipe. When these bounce off a reflecting surface (such as a valve or a bend in the pipe) they generate standing waves that may produce resonance. The wave speed is calculated using the known acoustic modes in a fluid-filled pipe, which is dominantly the tube wave but could also include the flexural wave. Resonant conditions are achieved when the pump frequency matches the acoustic natural frequency of the fluid-piping system.

When the piping system comprises elbows, tees, or diameter changes, pressure pulsations can lead to piping vibrations, a phenomenon termed acoustic-mechanical coupling. Any piping system also has natural frequencies associated with it. If the vibration-inducing frequency (or the pump pressure pulse frequency) matches the natural frequencies of the piping system, it induces mechanical resonance; and the vibration forces, stresses, and amplitudes can be excessive.

In addition to establishment of acoustic or mechanical resonance, the tube waves generated at each pump combine in the piping manifold 160 and various locations in constructive and destructive fashion. If these waves combine in a constructive fashion that leads to large pressure pulsations, the acoustic-mechanical coupling can lead to excessive vibrations.

While the internal offset within a given pump 140 may serve to mitigate vibration, with added reference to FIG. 1, the pump 140 is likely to be one of a host of pumps 140-149 for oilfield operations relating to stimulation, fracturing, cementing or other oilfield applications. With these potential issues in mind, embodiments herein provide a unique manner of reducing constructive interference among the different simultaneously operating pumps 140-149 of the system 100 and not just within a given pump 140. Further, one pump 140 of the system may serve as a regulation pump 140.

With specific reference to FIG. 2A, the regulation pump 140 may have a control interface 200 that is communicatively coupled to the control unit 110 of FIG. 1. The interface 200 may in turn be configured to temporarily adjust the rpm of the pump 140 as alluded to above, based on direction from the control unit 110. Thus, as detailed further below with reference to FIGS. 3A, 3B and 5, over the course of operations, the control unit 110 may direct the interface 200 to alter the overall pumping phase of the pump 140 when desired. In this manner, a level of destructive interference may be achieved to the overall operating system 100 of FIG. 1 to help mitigate the pressure pulsations throughout the system 100.

With added reference to FIG. 1 and as also detailed further below, the determination to change the phase or speed of the regulating pump 140 may be made based on sampling of pressure variations or other vibration-related information throughout the system 100. For example, in the embodiment of FIG. 2A, a sensor 201 is located at the discharge pipe 230 of the regulation 140 and other pumps 141-149. However, such information may also be acquired from the manifold 160 or other piping more remote from the individual pumps 140-149 (see FIG. 4). Regardless, as described below, this vibration (or pressure) related information may be used to determine when to begin randomly inducing phase timing changes through the regulating pump 140 and, perhaps more notably, when to stop inducing these timing changes based on the level of vibration (or pressure pulsation) reduction achieved.

Figure 3A:
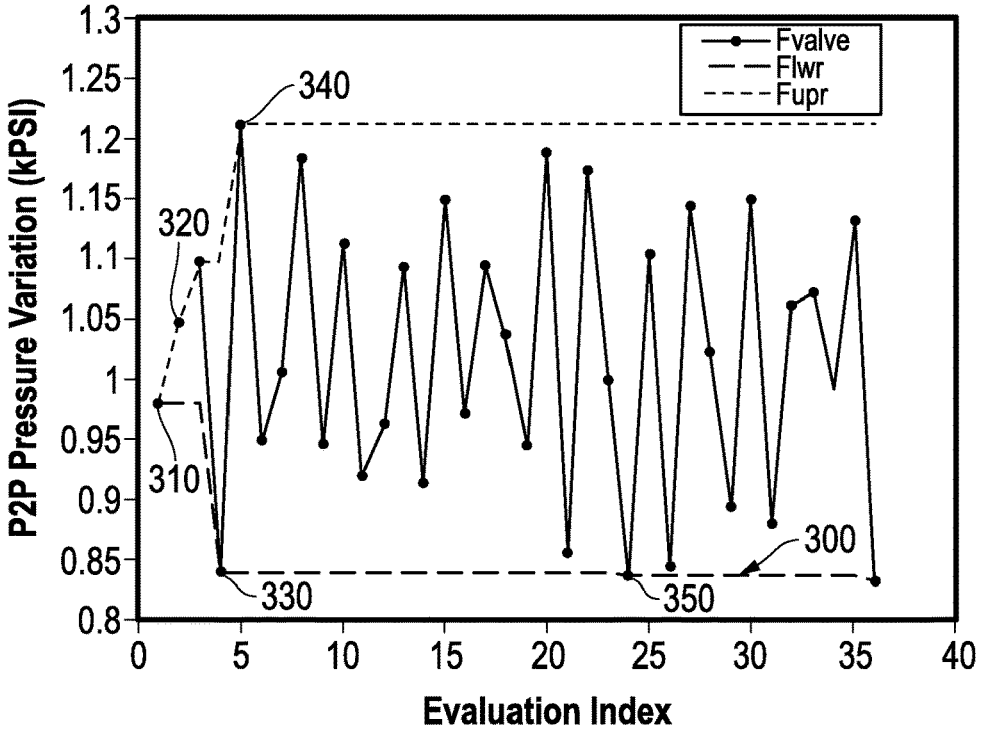
FIG. 3A is a chart representing a simulation of random sampling of pressure variations for the system of FIG. 1 during operations thereof.

Referring now to FIG. 3A with added reference to FIG. 1, a chart is shown representing a simulation of random sampling of pressure variations for the system 100 during operations that include introducing random perturbations. That is, with the hydraulic architecture of the system 100 known as well as initial operating speeds of and other characteristics of the pumps 140-149, a simulation may be run with pressure variations, for example, detected near the manifold 160 and recorded at the control unit 110. Of course, in another embodiment, the pumps 140-149 may actually be run for a brief period and actual data recorded to generate the chart of FIG. 3A. Regardless, the value of the initial information reflected by the chart of FIG. 3A lies primarily in the establishing of a substantially minimal or lower bound 300 of pressure variation for the operating system 100. This lower bound information may then be used as described below to help guide operations of the system 100 on an ongoing basis.

As indicated above, the chart of FIG. 3A reflects peak-to-peak pressure variations. Specifically, the chart of FIG. 3A shows that at the outset of the simulation, collected data may be recorded that reflects just under about 1,000 psig of pressure variation for a given sample period (see 310). So, for example, an analysis of pressure data from hydraulic lines of the system 100 acquired at a high frequency (e.g. above a 60-2,000 Hz range) and over a 2-4 second period may reveal a pressure fluctuation for the sample period of a little under 1,000 psig. As described above, this type of pressure pulsation may be an accurate indicator of the degree of vibration through the system 100.

As also indicated above, FIG. 3A reflects not just an initial pressure variation 310, but also a host of other pressure variations 320, 330, 340, 350 over time that correspond to specifically introduced random perturbations. For example, in the simulation of the operating system 100 of FIG. 1, it may be initially presumed that each of the pumps 140-149 are operating at about 200 rpm, perhaps without accounting for any initial phase information on a pump by pump basis. Thus, at the outset, the amount of potential constructive interference that may be present in the simulation of the operating system 100 may not be known. Nevertheless, as indicated above, an initial pressure variation 310 may be recorded. However, the degree of pressure variation may be sampled again following a first perturbation. For example, the rpm of the regulation pump 140, may be temporarily moved down from about 200 to about 195, perhaps for less than a second, and then immediately restored to 200. Given that the rpm only momentarily strays from 200, there is no substantial effect on flow from the pump 140. Instead, the temporary reduction in rpm changes the phase of the reciprocating triplex pump 140. As a result, the degree of constructive (or destructive) contribution to the overall hydraulic system 100 will be altered. As indicated at 320, this initial perturbation has constructively added to an increased pressure variation for the system 100 (e.g. notice the recorded sample at 320 moved up to a little over 1,000 psig).

While the initial perturbation resulting from moving the pump speed down for a moment actually increased the pressure variation (see 320), this would not always be the case in a dynamic system 100 of continuously operating multiplex pumps 140-149. Indeed, the chart of FIG. 3A reflects 35 or so additional simulated perturbations induced through the regulation pump 140. Each of these perturbations may involve a temporary reduction in pump rpm as described above. Alternatively, there may be a temporary increase in rpm. Regardless of the manner in which each perturbation is introduced, the result will sometimes be a sampled pressure variation that is notably decreased (see 330 and 350 at below about 850 psig). Other times, the perturbation will result in a notable increase in pressure variation (see 340 at over 1,200 psig).

Regardless of whether any given perturbation raises or lowers the recorded pressure variation, once a sufficient number of perturbation samples have been recorded, perhaps over about a ten minute period of time, a picture will begin to emerge of a particular system's upper and lower 300 bounds. For example, the chart of FIG. 3A reveals that for the system 100 of FIG. 1, the maximum pressure variation appears to be at about 1,200 psig. Specifically, after about 35 different perturbations have been introduced only a few result in anything close to the level seen at 340. By the same token, after running this number of perturbations, it is also evident that the lowest reasonable level (i.e. the lower bound 300) of pressure variation that might be expected is between about 800 psig and about 850 psig. Therefore, armed with this random walk type of simulated perturbation information, once the system 100 is put to actual long term use, operators may employ a technique that relies upon this information. Specifically, as detailed below with respect to FIG. 3B, the system 100 in operation may be periodically tweaked until a lower level pressure variation of no more than about 850 psig is established for long term operation. Thus, instead of unintentionally continuing operation at pressure variations over 1,000 psig, and more likely harming hydraulic equipment, the system 100 may be operated near continuously closer to the lower bound of about 850 psig of pressure variation. This control scheme may be used at a plurality of locations in the piping/manifold. That is, the peak-to-peak pressure pulsations may be minimized at a number of locations simultaneously or in aggregate.

Figure 3B:
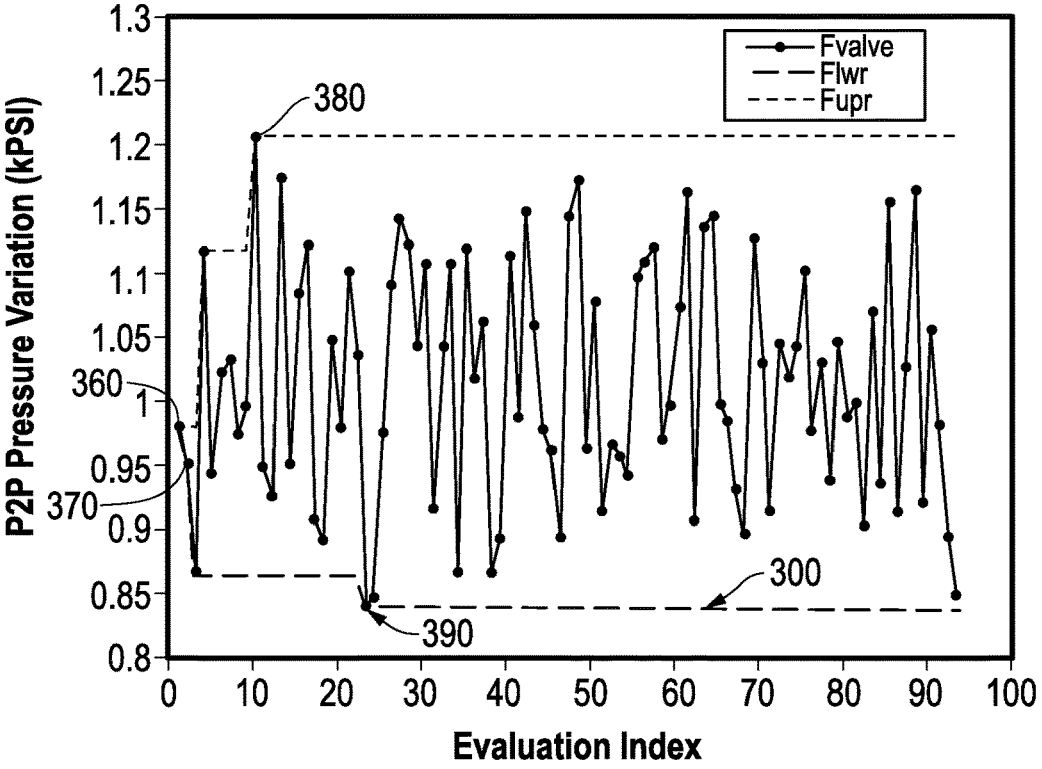
FIG. 3B is a chart representing use of the simulated pressure variation information of FIG. 3A in actual long term operations of the system of FIG. 1.

Referring now to FIG. 3B, a chart is shown which reflects the simulation information of FIG. 3A put to use in actual long term operation of the pumps 140-149 of FIG. 1. That is, the system 100 is dynamic, with an assortment of multiplex pumps 140-149 in seemingly random phases. Thus, the precise timing and conditions simulated at a given moment as reflected in the chart of FIG. 3A is not readily repeatable as a practical matter. Nevertheless, the information acquired during the simulation of FIG. 3A may still be utilized during operations as reflected in FIG. 3B.

In FIG. 3B, an initial random sample of pressure variation 360 reveals a psig of just below about 1,000 psig is present in the operating system 100 of FIG. 1. With reference to the data available from 3A, it is known that for this particular system 100 operating at the same parameters as those simulated, a variation of no more than about 850 psig should be attainable. That is, a lower bound of 850 psig has been established as detailed above. Therefore, another random walk, with a series of perturbations may take place through the operating system 100 in the same fashion as detailed above for the simulation that initially provided the lower bound 300. For example, a temporary reduction in rpm may take place through the regulation pump 140 to provide a phase change. As indicated at 370, a reduction in pressure variation may result. However, upon this initial perturbation, the variation is still well over 850 psig. Thus, continued perturbations may ensue in an effort to reach a level close to the lower bound 300. Of course, in some circumstances, a perturbation may result in notable increases in pressure variation (see 380). Nevertheless, at some point, a sufficient number of perturbations will ultimately lead to attaining a variation at about the lower bound 300 (see 390).

In the chart of FIG. 3B, over 90 different perturbations are shown applied to the operating system 100 of FIG. 1. However, it is evident that the lower bound 300 is attained after about 21 different random perturbations (again see 390). Thus, while it is possible to continue randomly inserting different perturbations to the system 100 in an effort to reduce the variation even further, it is apparent that this is not a necessary undertaking. That is, armed with the lower bound 300 information from the simulation 100 of FIG. 3A, the operator may discontinue the control mode manner of introducing perturbations once the lower bound 300 is substantially achieved. With particular reference to FIG. 3B, this means that the control mode tweaking of pump operations may cease after about 21 different perturbations.

In actual practice, ten minutes and between about 30 and 40 different randomly carried out and sampled perturbations may be sufficient to obtain a reliable lower bound 300. Once more, with this information available, the time and number of samples necessary to get the system 100 to operate near the lower bound may be fewer. For example, as shown in FIG. 3B, a few minutes and between about 20 and 30 different random perturbations may be sufficient to achieve the lower bound 300 of less than about 850 psig in pressure differential. Of course, if an operator is fortunate enough to achieve the lower bound 300 after only one or two different perturbations, the control mode may be terminated at that point without need for additional perturbations. This means that not only is a lower bound 300 attainable through application of the described technique, but it is attainable in a relatively short period of time without the need for undue time spent with the system 100 operating at higher variation levels (e.g. such as at 1,200 psig).

Figure 4:
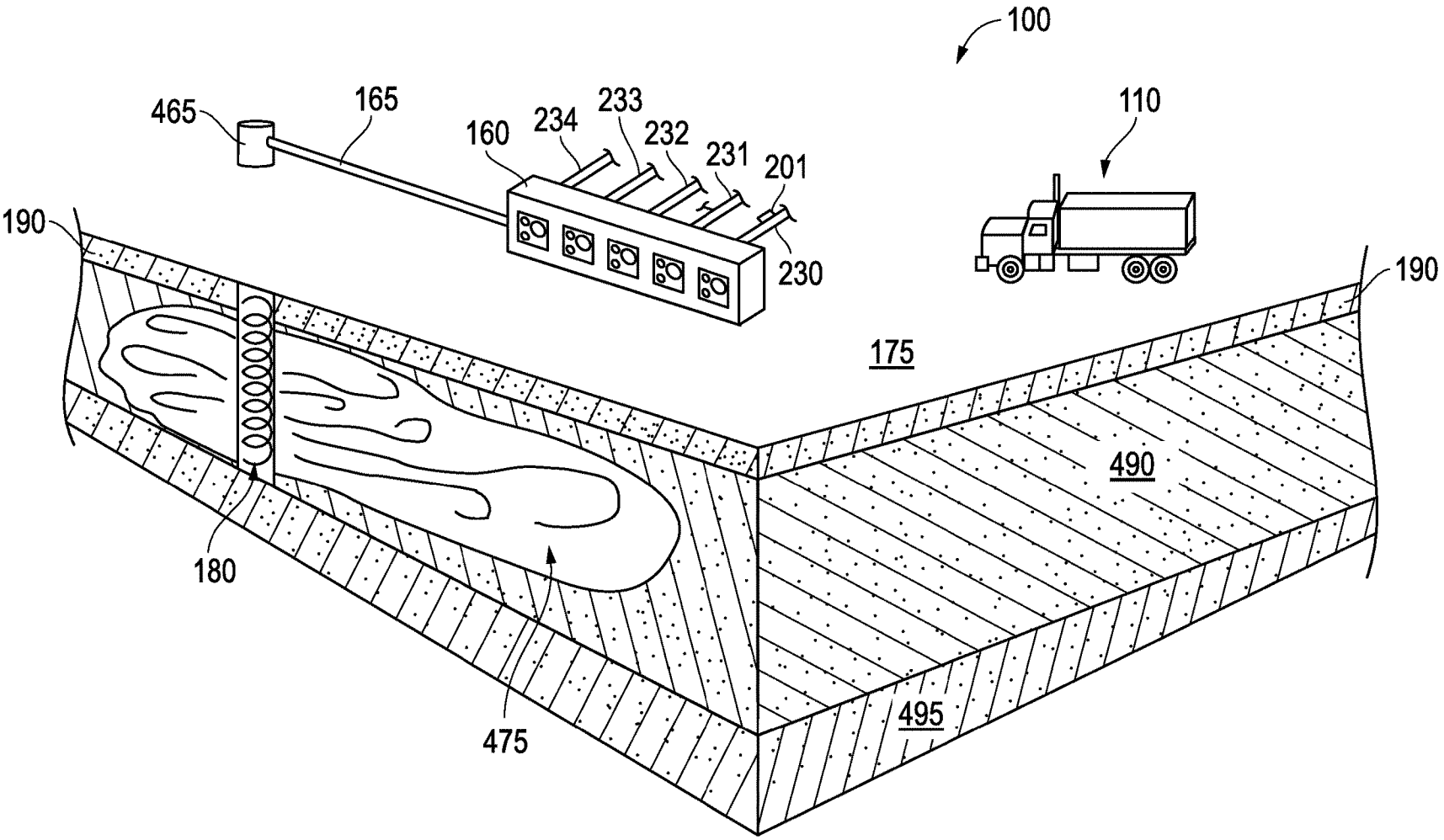
FIG. 4 is a schematic overview depiction of the system at the oilfield of FIG. 1 in operation and employing a vibration minimization technique for a stimulation.

Referring now to FIG. 4, a schematic overview depiction of the system 100 at the oilfield 175 of FIG. 1 is shown in operation and employing a vibration (or a pressure pulsation) minimization technique for a stimulation. In this embodiment, a vibration sensor 201 is shown externally located on a discharge pipe 230 closer to the manifold 160. Of course, as described above, more internal pressure variation monitoring may be utilized for running the control mode. Regardless, a host of pipes 230-234 may be run to the manifold 160 from a host of triplex pumps 140-149 as shown in FIG. 1. Thus, a line 165 running to a wellhead 465 may support a high pressure stimulation operation 475 via a well 180 traversing various formation layers 190, 490, 495. Nevertheless, while high flow rates and pressures of between about 10,000 and 20,000 psig may be involved, a lower bound of pressure variation and associated vibration may be substantially maintained during operations. Thus, the odds of a vibration-induced catastrophic event taking place during long term operations may be substantially reduced.

Figure 5:
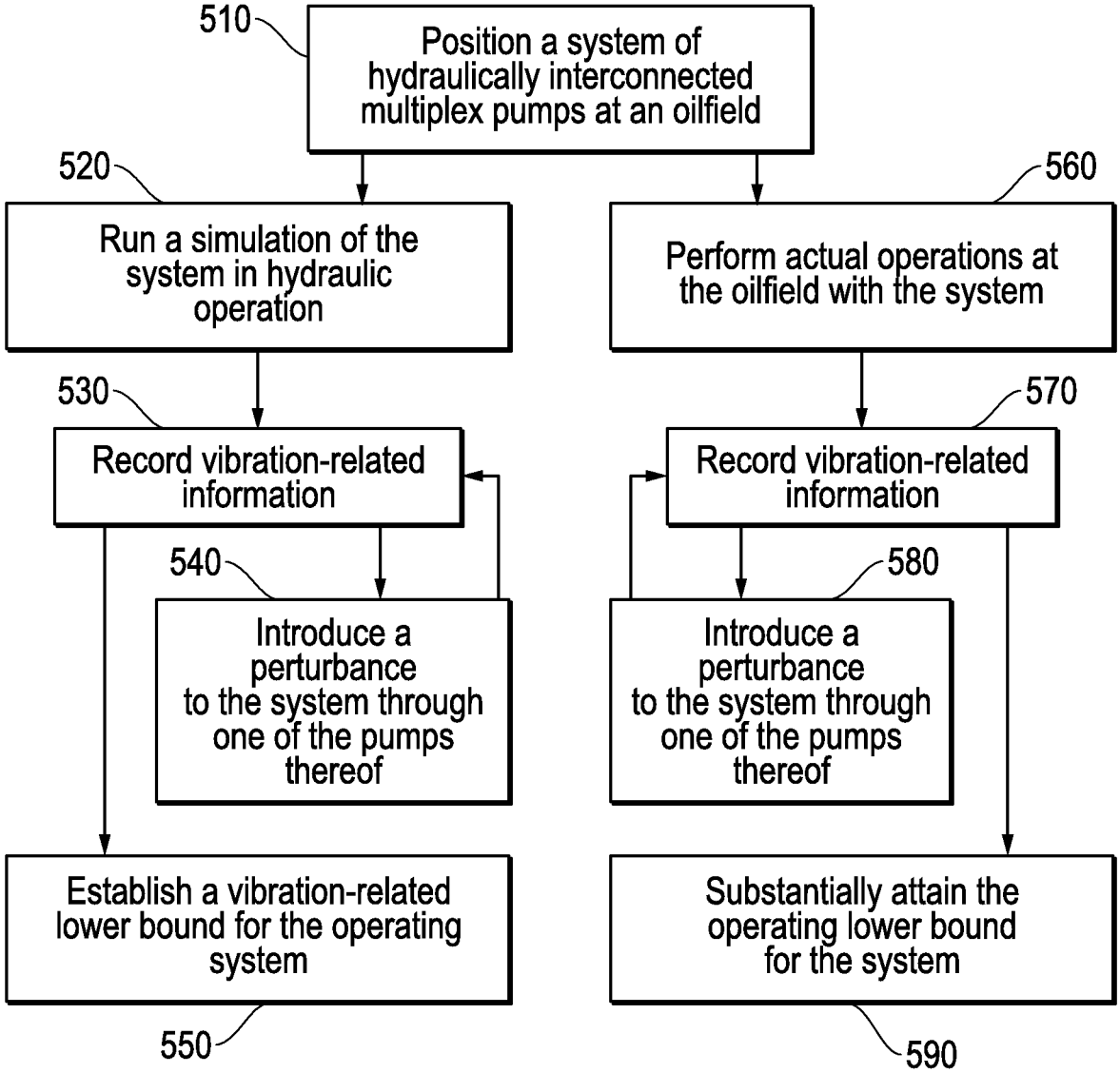
FIG. 5 is a flow-chart summarizing an embodiment of employing a vibration minimization technique for a multi-pump system at an oilfield.

Referring now to FIG. 5, a flow-chart summarizing an embodiment of employing a vibration minimization technique for a multi-pump system at an oilfield is shown. Specifically, such a system utilizing multiplex pumps, that are inherently and randomly subject to being both in and out of phase with one another, is set up at an oilfield as indicated at 510. A simulation or sampling of the behavior of such a system may be run as indicated at 520. Specifically, this may involve recording vibration related information such as pressure variations (see 530) and introducing random perturbations to the system (see 540) to track the effects thereof. Eventually, as noted at 550, a lower bound for the particular system may be established (as well as an upper bound).

With lower bound information in hand (as well as upper bound information), oilfield operations may begin more in earnest as indicated at 560. Specifically, through a control mode technique, vibration related information may again be recorded (see 570) as perturbations are introduced (see 580). Thus, the known lower bound may be substantially attained as indicated at 590.

Embodiments described above allow for operators to effectively reduce or minimize the overall vibration inducing character of a multi-pump system utilizing multiplex pumps. This is achieved in a practical manner that does not require full time, all-encompassing control over each pump of such a highly dynamic system.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, while perturbations are introduced for sake of establishing and attaining a lower bound of vibration throughout the operating system, these may be introduced for other effective purposes. Specifically, perturbations may be utilized to alter the behavior of each plunger within each pump during reciprocation so as to smooth out the sinusoidal behavior thereof, thereby reducing each pump's individual overall vibration-inducing character. Furthermore, the foregoing description should not be read as pertaining only to the precise structures described and shown in the accompanying drawings, but rather should be read as consistent with and as support for the following claims, which are to have their fullest and fairest scope.

We claim:

1. A method of minimizing vibration in an operating multi-pump system of multiplex pumps, the method comprising:

determining a vibration-related lower bound of pressure variation for the multi-pump system through at least one of running the multi-pump system for a brief initial period of time and running a simulation of the multi-pump system;

after determining the vibration-related lower bound of pressure variation, operating each multiplex pump of the multi-pump system;

recording vibration-related information during operation of the multi-pump system;

introducing a series of differing perturbations to the multi-pump system through a pump subset of the multi-pump system to generate new vibration-related information; and upon attaining approximately the vibration-related lower bound of pressure variation while operating the multi-pump system at a given perturbation of the series of differing perturbations discontinuing further introduction of perturbations to the multi-pump system to enable continued operation of the multi-pump system at approximately the vibration-related lower bound of pressure variation.

2. The method of claim 1 further comprising substantially operating the multi-pump system near-continuously at the lower bound upon the attaining thereof.

3. The method of claim 1 wherein the vibration-related lower bound is a lower bound of pressure variation substantially reflecting a maximally attainable deconstructive interference among the operating pumps of the multi-pump system.

4. The method of claim 1 further comprising establishing a vibration-related upper bound for the multi-pump system and wherein the establishing of the vibration-related upper and lower bounds comprises:

storing vibration-related information at a control unit of the multi-pump system; and randomly introducing separate perturbations to the system through a pump subset of the multi-pump system to generate new vibration-related information sufficient for the establishing of the upper and lower bound.

5. The method of claim 4 wherein the storing of the vibration-related information and the randomly introduced separate perturbations take place through simulation at the control unit.

6. The method of claim 4 wherein introducing a perturbation to the multi-pump system comprises:

momentarily introducing a change in rpm of the pump subset to effect a phase change; and restoring the rpm of the pump subset to substantially maintain flow rate through the pump sub set.

7. The method of claim 6 wherein the pump subset exclusively comprises a single regulation pump of the multi-pump system communicatively coupled to the control unit.

8. The method of claim 7 wherein the momentary introduction of rpm change to the single regulation pump takes place over a period of less than about one second.

9. The method of claim 1 wherein the establishing of the lower bound takes no more than about ten minutes.

10. The method of claim 1 wherein the substantially attaining the vibration-related lower bound with the operating system requires an amount of time less than that required to determine the vibration-related lower bound.

11. A method of performing an application in a well at an oilfield with the assistance of a multi-pump system of multiplex pumps, the method comprising:

determining a vibration-related lower bound of pressure variation for the multi-pump system through at least one of running the multi-pump system for a brief initial period of time and running a simulation of the multi-pump system;

operating each pump of the multi-pump system;

introducing a series of differing perturbations to a pump of the multi-pump system to determine a resulting change in pressure variations in the multi-pump system;

continuing this series of differing perturbations until a given perturbation results in approximately the vibration-related lower bound of pressure variation to thus reduce vibration during operation of the multi-pump system;

maintaining operation of the multi-pump system with the given perturbation to enable continued operation of the multi-pump system at the vibration-related lower bound of pressure variation and thus with reduced vibration; and performing the application in the well.

12. The method of claim 11 wherein introducing a perturbation comprises temporarily altering a speed of a one of pumps.

13. The method of claim 11 wherein the application is one of a downhole fracturing, stimulating and cementing application.

14. A multi-pump system for use at an oilfield, the system comprising:

a plurality of multiplex pumps for supplying a pressurized fluid to a well at the oilfield for an application therein;

at least one sensor for acquiring vibration-related information from the system during operation thereof;

a control unit for obtaining the vibration related information to establish a vibration-related lower bound of pressure variation in the plurality of multiplex pumps based on at least one of running the plurality of multiplex pumps for a brief period of time and running a simulation of operation of the plurality of multiplex pumps; and an interface at a regulation pump of the plurality to randomly and momentarily change rpm thereof as directed by the control unit during subsequent operation of the plurality of multiplex pumps to introduce a series of perturbations to a multiplex pump of the plurality of multiplex pumps until introduction of a given perturbation results in substantially attaining the vibration-related lower bound of pressure variation for the system to enable continued operation of the plurality of multiplex pumps at approximately the vibration-related lower bound of pressure variation.

15. The multi-pump system of claim 14 further comprising reflecting hardware in hydraulic communication with the plurality of multiplex pumps to assist the supplying of the pressurized fluid, the hardware of increased survivability upon the attaining of the lower bound during the operation of the system.

16. The multi-pump system of claim 14 further comprising a manifold for managing the pressurized fluid to the well for the application.

17. The multi-pump system of claim 16 wherein the sensor is a pressure sensor located substantially at the manifold.

18. The multi-pump system of claim 14 wherein each of the pumps is configured to operate at between about 200 Hp and about 4,000 Hp.

19. The multi-pump system of claim 14 wherein the fluid is pressurized from below about 20 psig to over about 15,000 psig.

* * * * *